US007574880B2

(12) United States Patent
Yang

(10) Patent No.: US 7,574,880 B2
(45) Date of Patent: Aug. 18, 2009

(54) KEY LOCK STRUCTURE

(76) Inventor: Kai-Lang Yang, P.O. Box 26-757, Taipei 106 (TW)

( * ) Notice: Subject to any disclaimer, the term of this patent is extended or adjusted under 35 U.S.C. 154(b) by 245 days.

(21) Appl. No.: 11/827,276

(22) Filed: Jul. 12, 2007

(65) Prior Publication Data

US 2009/0013738 A1 Jan. 15, 2009

(51) Int. Cl.
*E05B 37/16* (2006.01)

(52) U.S. Cl. ..... 70/25; 70/214; 70/288; 70/295; 70/298; 70/299; 70/317; 70/322

(58) Field of Classification Search ..... 70/21–26, 70/214, 287, 288, 294–300, 315–318, 313, 70/321–324, DIG. 22, DIG. 25, DIG. 44, 70/DIG. 75, DIG. 76
See application file for complete search history.

(56) References Cited

U.S. PATENT DOCUMENTS

| | | | | | |
|---|---|---|---|---|---|
| 1,085,894 | A * | 2/1914 | Eagle | 70/298 |
| 1,300,020 | A * | 4/1919 | Rial et al. | 70/298 |
| 1,871,303 | A * | 8/1932 | Chesick | 70/284 |
| 2,109,264 | A * | 2/1938 | Elbaum | 70/298 |
| 3,192,746 | A * | 7/1965 | Lehman | 70/315 |
| 3,256,723 | A * | 6/1966 | Lehman | 70/25 |
| 3,844,147 | A * | 10/1974 | Windle | 70/298 |
| 3,937,046 | A * | 2/1976 | Wang | 70/81 |
| 4,660,394 | A * | 4/1987 | Wu | 70/25 |
| 4,748,833 | A * | 6/1988 | Nagasawa | 70/214 |
| 4,787,224 | A * | 11/1988 | Mesa | 70/313 |
| 4,862,714 | A * | 9/1989 | Taylor et al. | 70/25 |
| 4,866,958 | A * | 9/1989 | Bretl et al. | 70/25 |
| 4,936,894 | A * | 6/1990 | Larson et al. | 70/298 |
| 4,952,228 | A * | 8/1990 | Taylor et al. | 70/25 |
| 4,959,978 | A * | 10/1990 | Cappell et al. | 70/25 |
| 5,186,032 | A * | 2/1993 | Chia | 70/315 |
| 6,119,493 | A * | 9/2000 | Carter et al. | 70/26 |
| 7,010,944 | B1 * | 3/2006 | Chiu | 700/26 |
| 7,043,948 | B1 * | 5/2006 | Wang | 70/214 |
| 7,437,899 | B1 * | 10/2008 | Ma | 70/69 |
| 2002/0088256 | A1 * | 7/2002 | Taylor et al. | 70/25 |
| 2004/0261477 | A1 * | 12/2004 | Wang | 70/214 |
| 2007/0144226 | A1 * | 6/2007 | Miao | 70/214 |

* cited by examiner

*Primary Examiner*—Lloyd A Gall
(74) *Attorney, Agent, or Firm*—Rosenberg, Klein & Lee

(57) ABSTRACT

A key lock structure arranged in a mechanical key lock device refusing any code pressing while locked, so as to avoid finding out the correct codes by try and error. The key lock structure includes a casing, a sliding base disposed in the casing, an orientation frame arranged on a bottom face of the sliding base and a plurality of code-locked keystroke bodies. The sliding base has a plurality of elongation arms parallel to one another, a plurality of slots arranged with the elongation arms in an alternate manner, and a plurality of stop portions disposed in the respective slots. The orientation frame is disposed under the sliding base. Each of the code-locked keystroke bodies has a sliding member, which has an extrusion portion capable of being blocked by the respective stop portion. Consequently, the code-locked keystroke bodies are fixed and cannot be pressed in the lock status.

7 Claims, 8 Drawing Sheets

KEY LOCK STRUCTURE

BACKGROUND OF THE INVENTION

1. Site of the Invention

The present invention relates to a key lock structure, and in particular to a key lock structure arranged in a mechanical number lock device for lowering risks of being stolen.

2. Background of the Invention

Most market-sale mechanical key locks are of a function that locks part of keyboard keys depending on the number settings selected.

Without knowing lock numbers, the non-destruction manner for unlocking the mechanical key locks is repeat trying the different numbers while keep forcing a lock tongue in a predetermined direction.

Finding out the correct numbers in conventional mechanical key locks is troublesome, but still is effortless if keeping try and error. Besides, there is no order setting, which may raise trying times and reduce risks of being stolen, in the mechanical key locks.

SUMMARY OF THE INVENTION

It is the object of the present invention to provide a key lock structure refusing any code pressing and inputting while locked, so as to avoid finding out the correct codes by try and error.

The present invention provides a key lock structure arranged in a mechanical key lock device including a casing, a sliding base disposed in the casing, an orientation frame arranged on a bottom face of the sliding base and a plurality of code-locked keystroke bodies. The sliding base has a plurality of elongation arms parallel to one another, a plurality of slots arranged with the elongation arms in a alternate manner, a plurality of stop portions disposed in the respective slots, and a tongue portion and a manual push portion together extended from front ends of the elongation arms. The tongue portion is extruded from a front portion of the casing. The manual portion is extruded from a top face of the casing. The code-locked keystroke bodies penetrate the respective slots and the orientation frame. Each of the code-locked keystroke bodies has a first slit and a sliding member. The sliding member has an extrusion portion exposed out the respective code-locked keystroke body via the respective first slit and further blocked by the respective stop portion.

The key lock structure indeed achieves the object of the present invention refusing any code pressing and inputting to avoid finding out the correct codes by try and error.

To provide a further understanding of the invention, the following detailed description illustrates embodiments and examples of the invention. Examples of the more important features of the invention have thus been summarized rather broadly in order that the detailed description thereof that follows may be better understood, and in order that the contributions to the art may be appreciated. There are, of course, additional features of the invention that will be described hereinafter which will form the subject of the claims appended hereto.

BRIEF DESCRIPTION OF THE DRAWINGS

These and other features, aspects, and advantages of the present invention will become better understood with regard to the following description, appended claims, and accompanying drawings, wherein:

DETAILED DESCRIPTION OF THE EMBODIMENTS

Figure 1:
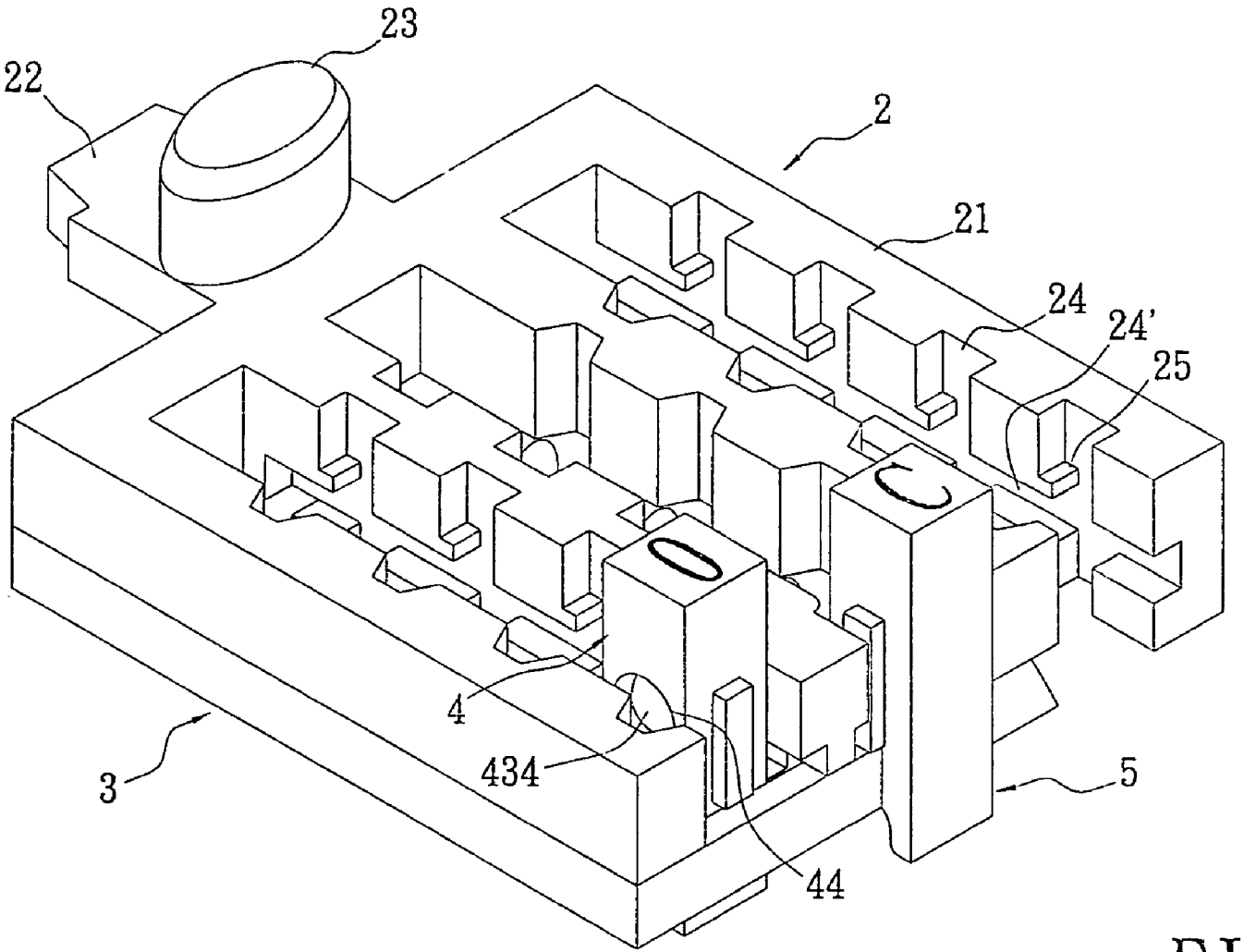
FIG. 1 is a perspective view of a key lock structure according to the present invention.

With respect to FIGS. 1 to 6, a key lock structure having a casing 1, a sliding base 2, an orientation frame 3, a plurality of code-locked keystroke bodies 4 and an arbitrary lock body 5 is disclosed.

The casing 1 is made of high-strength metallic materials. The sliding base 2, the orientation frame 3, the code-locked keystroke bodies 4 and the arbitrary lock body 5 are arranged in the casing 1 for avoid damages. The casing 1 has a plurality of openings formed on a top face thereof for being penetrated by a manual push portion 23, the code-locked keystroke bodies 4 and the arbitrary lock body 5. A bottom face of the casing 1 can be disposed on a door or a door case.

Figure 2:
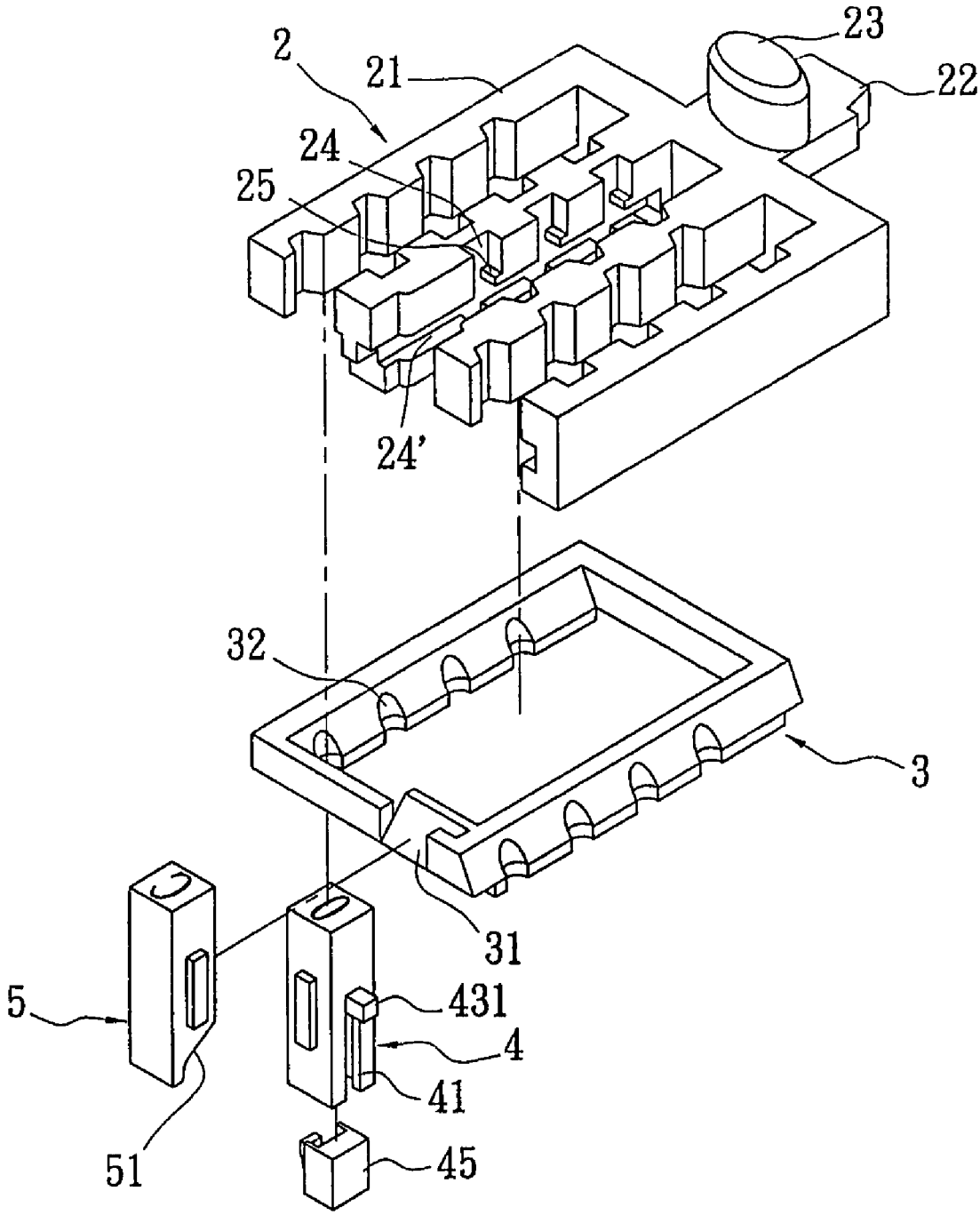
FIG. 2 is a decomposition view of the key lock structure according to the present invention.

The sliding base 2 illustrated in FIG. 2, has a plurality of elongation arms 21 parallel to one another, a plurality of vertical and horizontal slots 24 and 24' arranged with the elongation arms 21 in a alternate manner, a plurality of stop portions 25 disposed in predetermined intersections due to the respective vertical and horizontal slots 24 and 24', and a tongue portion 22 and the manual push portion 23 together extended from front ends of the elongation arms 21. The tongue portion 22 is extruded from a front portion of the casing 1 to engage with the door or the door case for locking. The manual push portion 23 extruded upwardly from the top face of the casing 1 for user operating the tongue portion 22. The tongue portion 22 can be operated to carry the sliding base 2 sliding in the casing 1 forwards and backwards for locking and unlocking. The manual push portion 23 moves outwardly to force the tongue portion 22 extruding outwardly is the lock status, on the contrary the manual push portion 23 moves inwardly is the unlock status. The vertical slots 24 are formed on each lateral sidewall of the respective elongation arms 21. The vertical and horizontal slots 24 and 24' are formed for receiving the respective code-locked keystroke bodies 4.

The orientation frame 3 is a rectangular metallic frame, and slides forwards and backwards on a bottom face of the sliding base 2. The orientation frame 3 encloses the slots 24 and 24'. The orientation frame 3 has a first ramp 31 formed on a corner thereof, and a plurality of arc slits 32 formed on two lateral edges thereof. The arc slits 32 correspond to the vertical slots 24 respectively. The arc slits 32 and the corresponding vertical slots 24 together form a pathway for the respective code-locked keystroke bodies 4 moving.

The code-locked keystroke bodies 4 penetrate the respective slots 24 and the orientation frame 3. The code-locked keystroke bodies 4 are even arrayed on the top face of the casing 1 for the user touching and pressing. Each of the code-locked keystroke bodies 4 has a first slit 41 formed on a lateral side and a sliding member 43 moving upwards and downwards therein. The sliding member 43 has an extrusion portion 431 exposed out the respective code-locked keystroke body 4 via the respective first slit 41. The extrusion portion 431 can move in the respective slot 24. When the key lock structure is enabled, the extrusion portion 431 is blocked by-the respective stop portion 25 in the respective slot 24, each code-locked keystroke body 4 cannot be pressed thereby.

Figure 3:
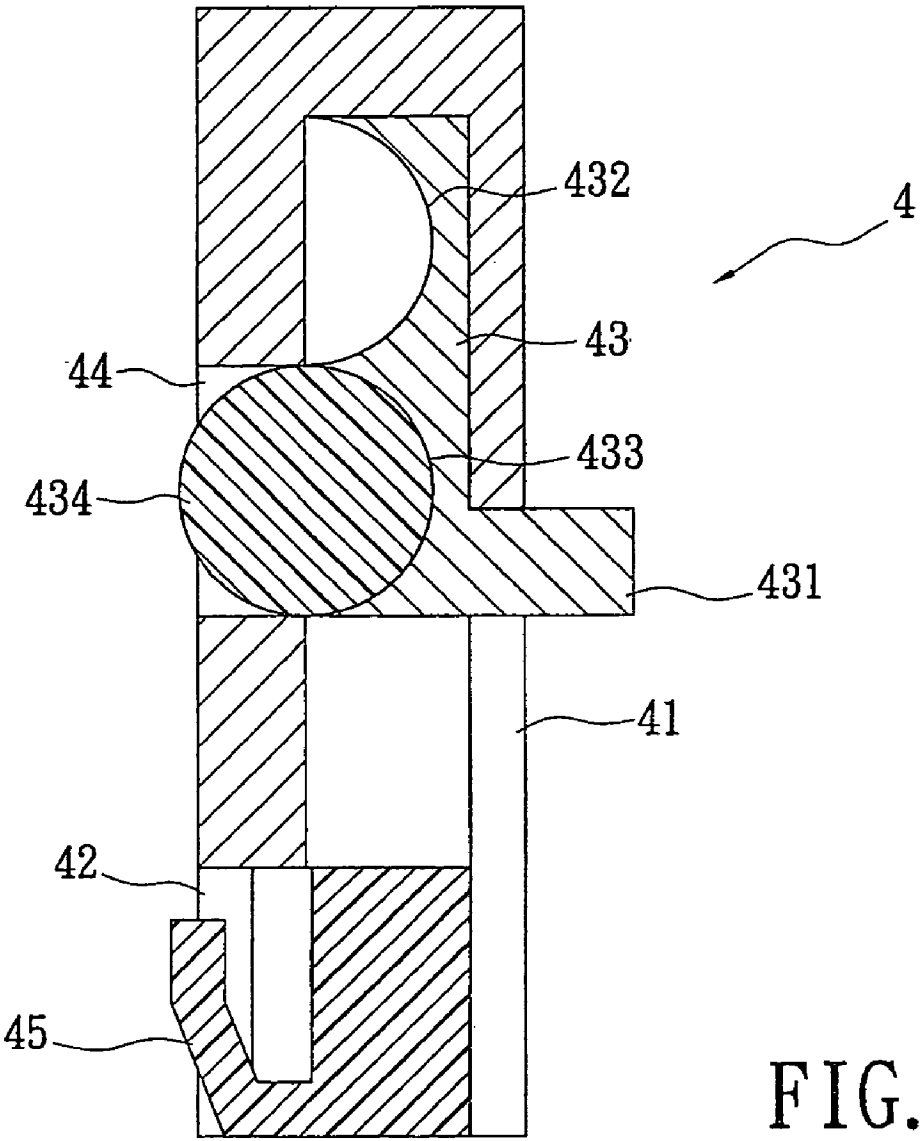
FIG. 3 is a cross-sectional profile of the key lock structure according to the present invention.

Each code-locked keystroke body 4 illustrated in FIG. 3 has a circular through hole 44 formed on an opposite side thereof. The sliding member 43 has a spheroid 434 and two spheroidic slots 432 and 433. The two spheroidic slots 432 and 433 are relative to the through hole 44, the spheroid 434 is alternatively arranged in two vacancies, which are formed between the through hole 44 and the two spheroidic slots 432 and 433 respectively.

Each code-locked keystroke body 4 has a second slit 42 formed on an opposite side thereof and a retaining member 45. The retaining member 45 is a spring made of plastic materials integrally in one piece. The retaining member 45 is exposed slantingly out of the respective code-locked keystroke body 4 via the second slit 42 for resisting against a lower portion of the orientation frame 3 or a lower portion of the sliding base 2.

By the combinations between the retaining member 45, the extrusion portion 431, the spheroid 434, and further the relative motion between the sliding base 2 and the orientation frame 3, the number setting, inputting and resetting are allowed.

The arbitrary lock body 5 is disposed on the orientation frame 3 and extrudes out of the top face of the casing 1. The arbitrary lock body 5 has a second ramp 51 mating with and corresponding to the first ramp 31. When the user press the arbitrary lock body 5, the second ramp 51 pushing the first ramp 31 to forcing the orientation frame 3 forwards.

Figure 5:
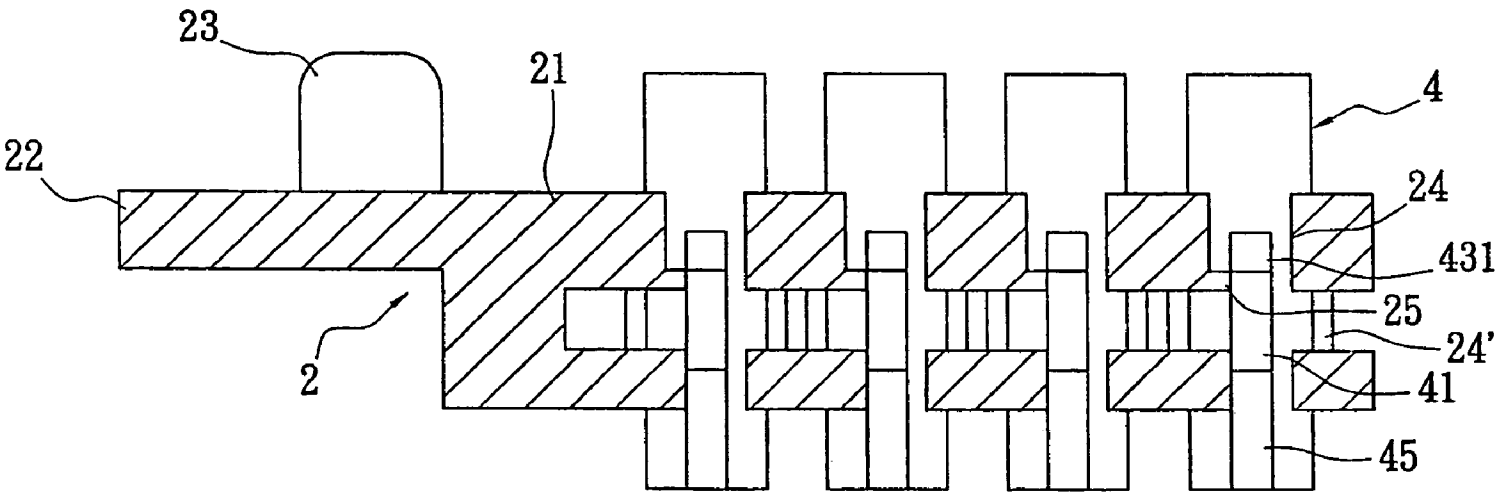
FIG. 5 is a perspective view of a key lock structure while unlocked according to the present invention.
Figure 6:
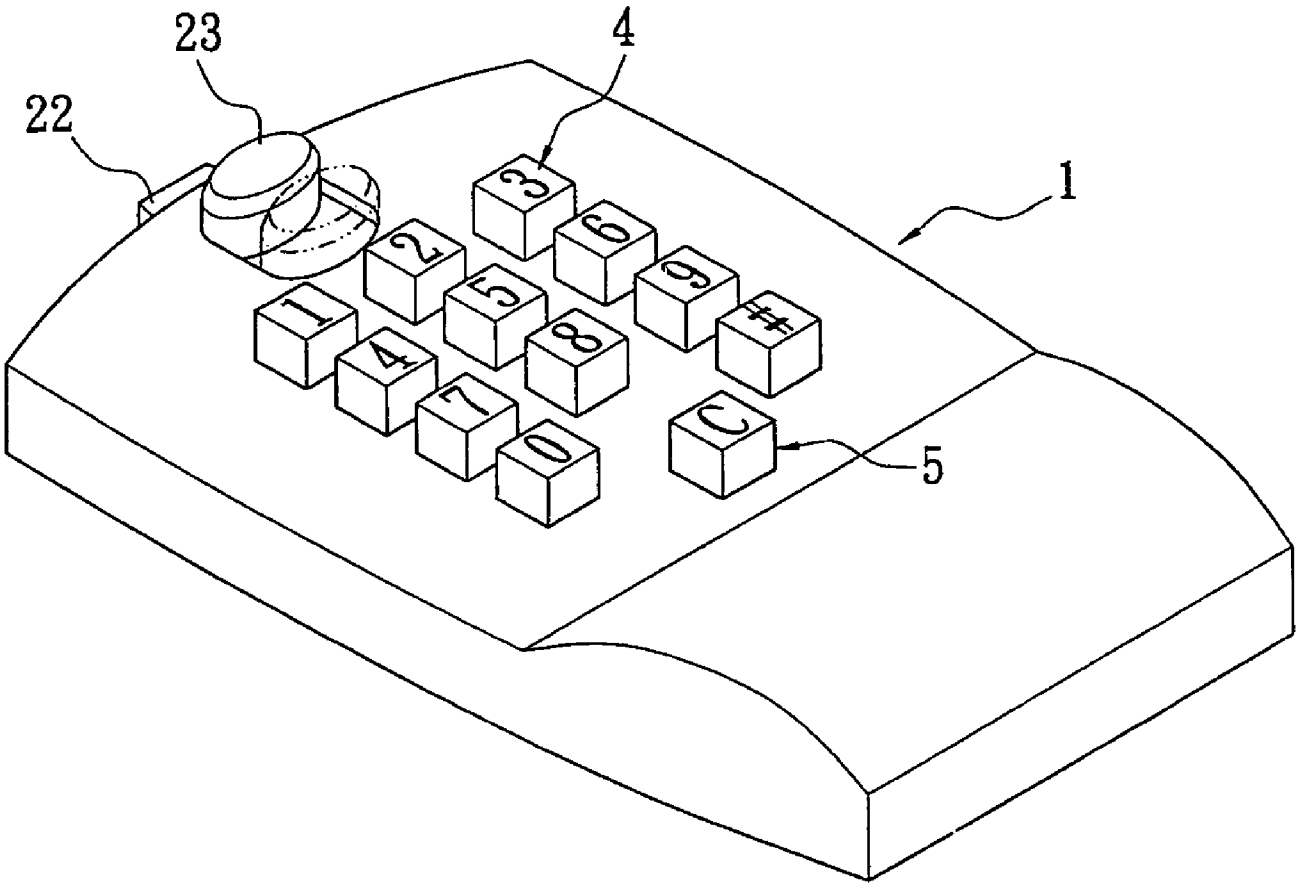
FIG. 6 is perspective view of a key lock structure arranged with a casing according to the present invention.

Referring in FIGS. 1 and 5, the code-locked keystroke bodies 4 and the arbitrary lock body 5 have numbered and signed characters, such as Arabic numerals, on respective surfaces thereof.

Under the code-locked keystroke bodies 4 and the arbitrary lock body 5, a plurality of springs (not shown) are arranged for supporting thereby. When part of the code-locked keystroke bodies 4 are pressed, the retaining member 45 moves downwardly thereby under the sliding base 2 to engage with the bottom face of the orientation frame 3. If the code-locked keystroke bodies 4 need to be back to the extrusion positions, the arbitrary lock body 5 can be pressed down to make the first ramp 31 mating with and forcing the second ramp 51. Thus, the orientation frame 3 moves forwards, the arc slits 32 of the orientation frame 3 correspond to the slots 24 of the sliding base 2 respectively, and a pathway is formed. The retaining member 45 can move in the pathway to lift the respective code-locked keystroke bodies 4, and the code-locked keystroke bodies 4 bounce and recover to extrusion positions.

Figure 4:
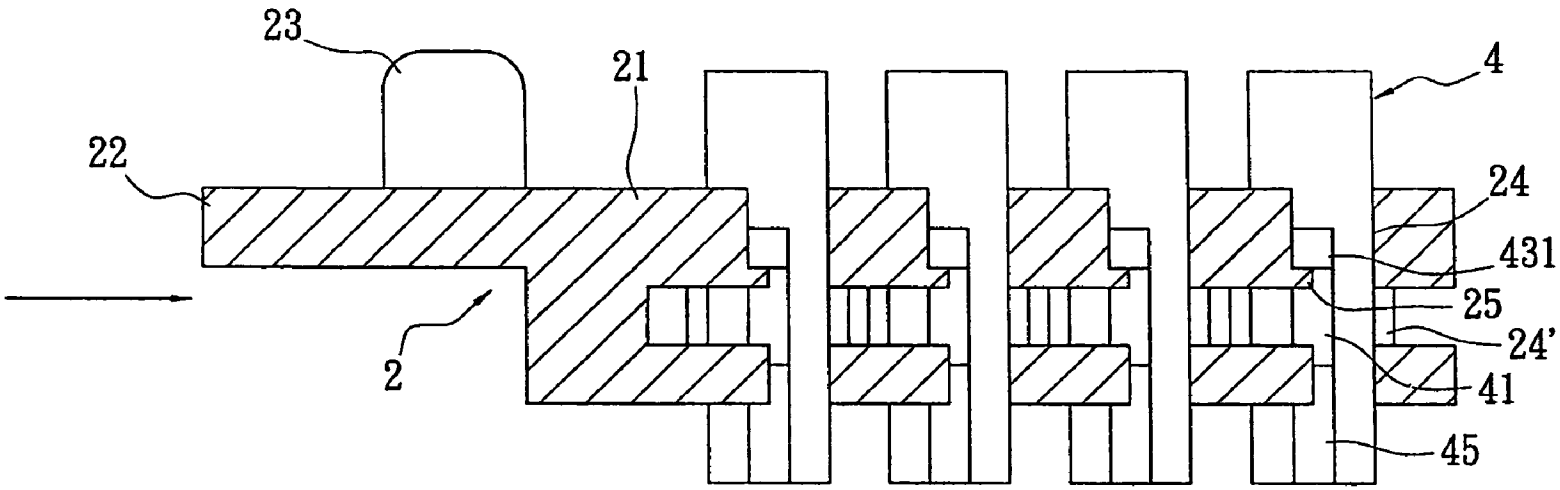
FIG. 4 is a perspective view of a key lock structure while locked according to the present invention.

With respect to FIG. 4, if any one, including thief, try to operate the manual push portion 23 in try and error, the extrusion portion 431 engaged with the respective stop portion 25 will make the corresponding code-locked keystroke body 4 incapable of being pressed. Therefore, no codes or numbers can be input or entered.

Figure 7:
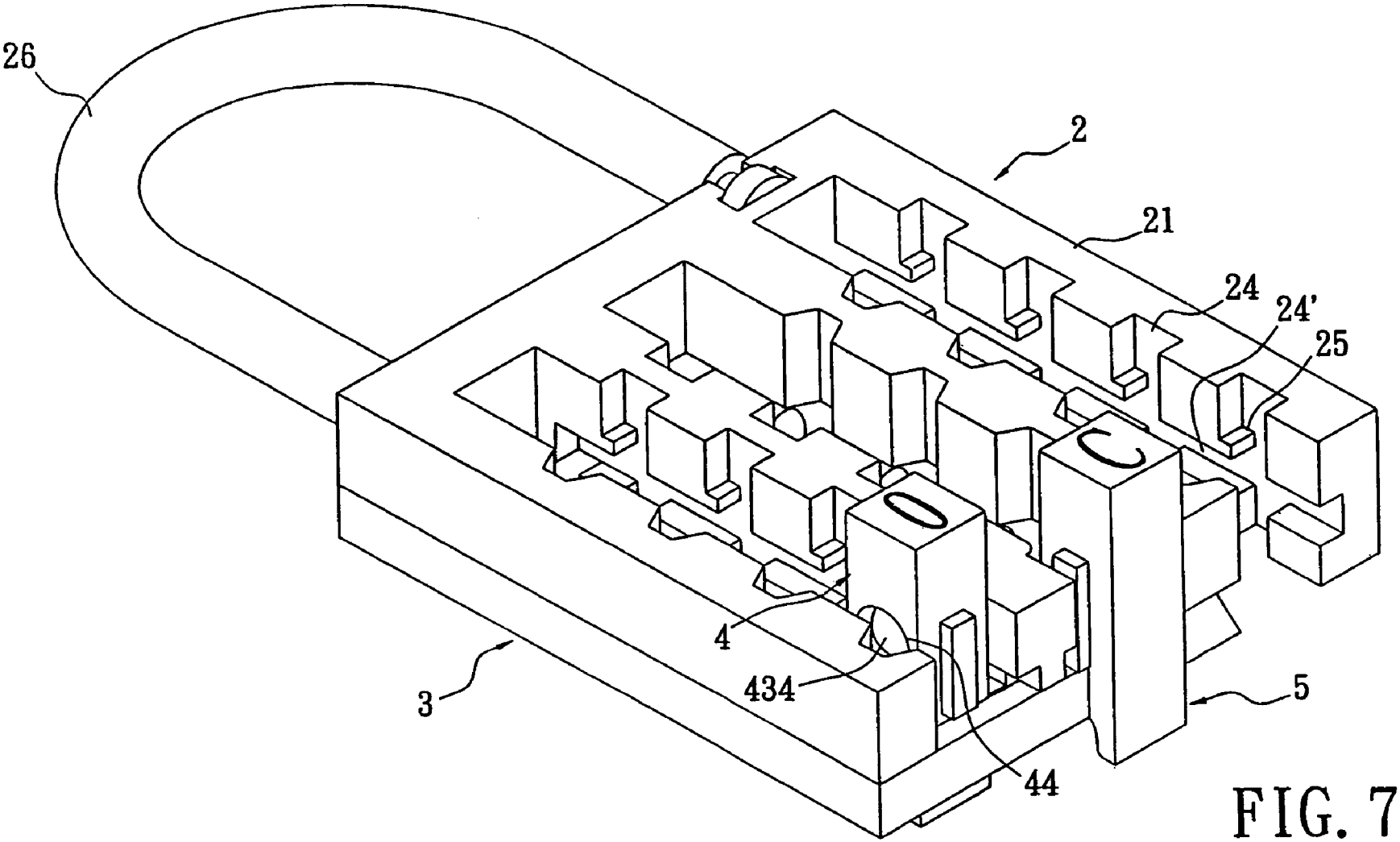
FIG. 7 is a perspective view of a key lock structure according to another embodiment of the present invention.
Figure 8:
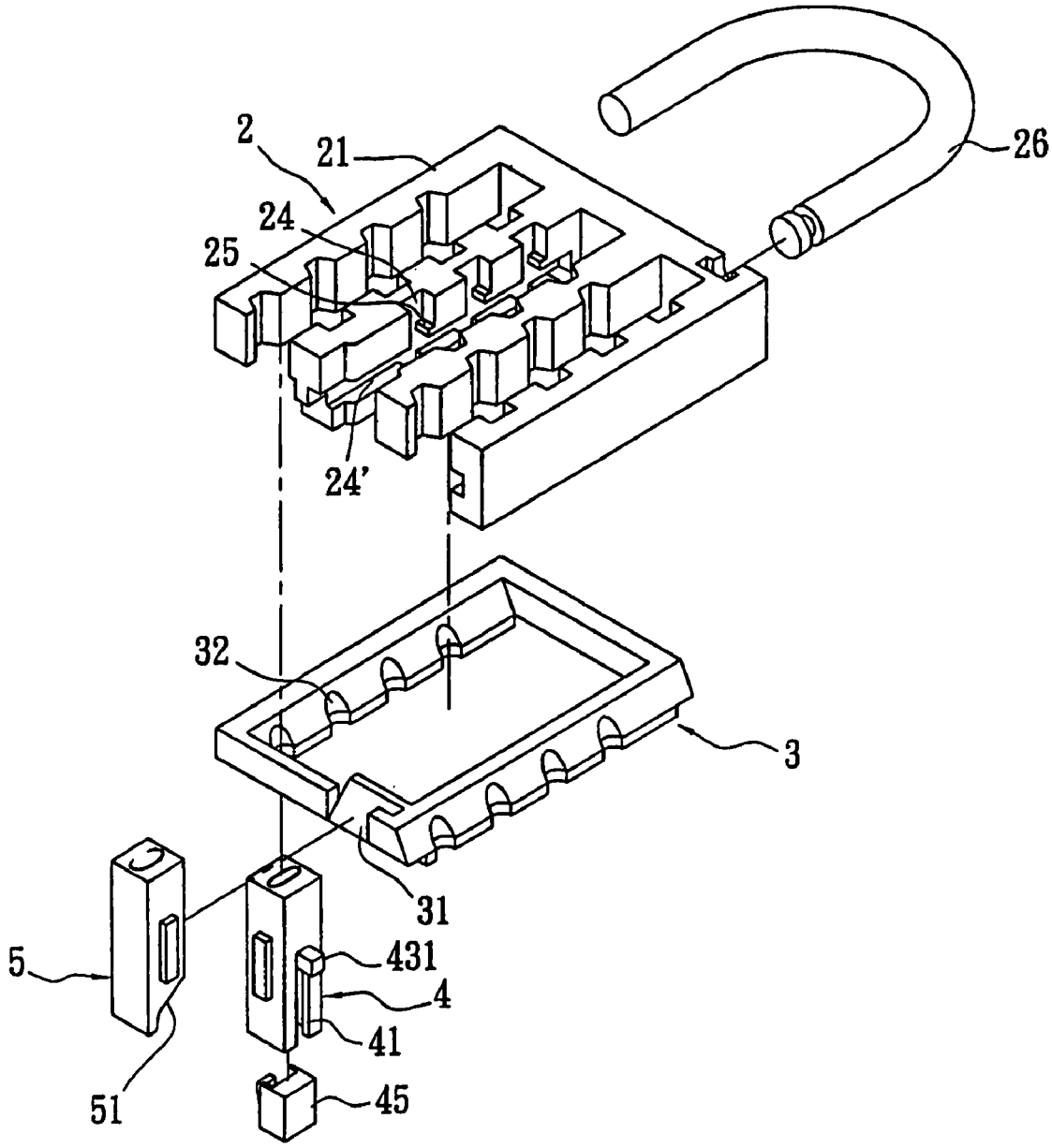
FIG. 8 is a decomposition view of the key lock structure according to another embodiment of the present invention.
Figure 9:
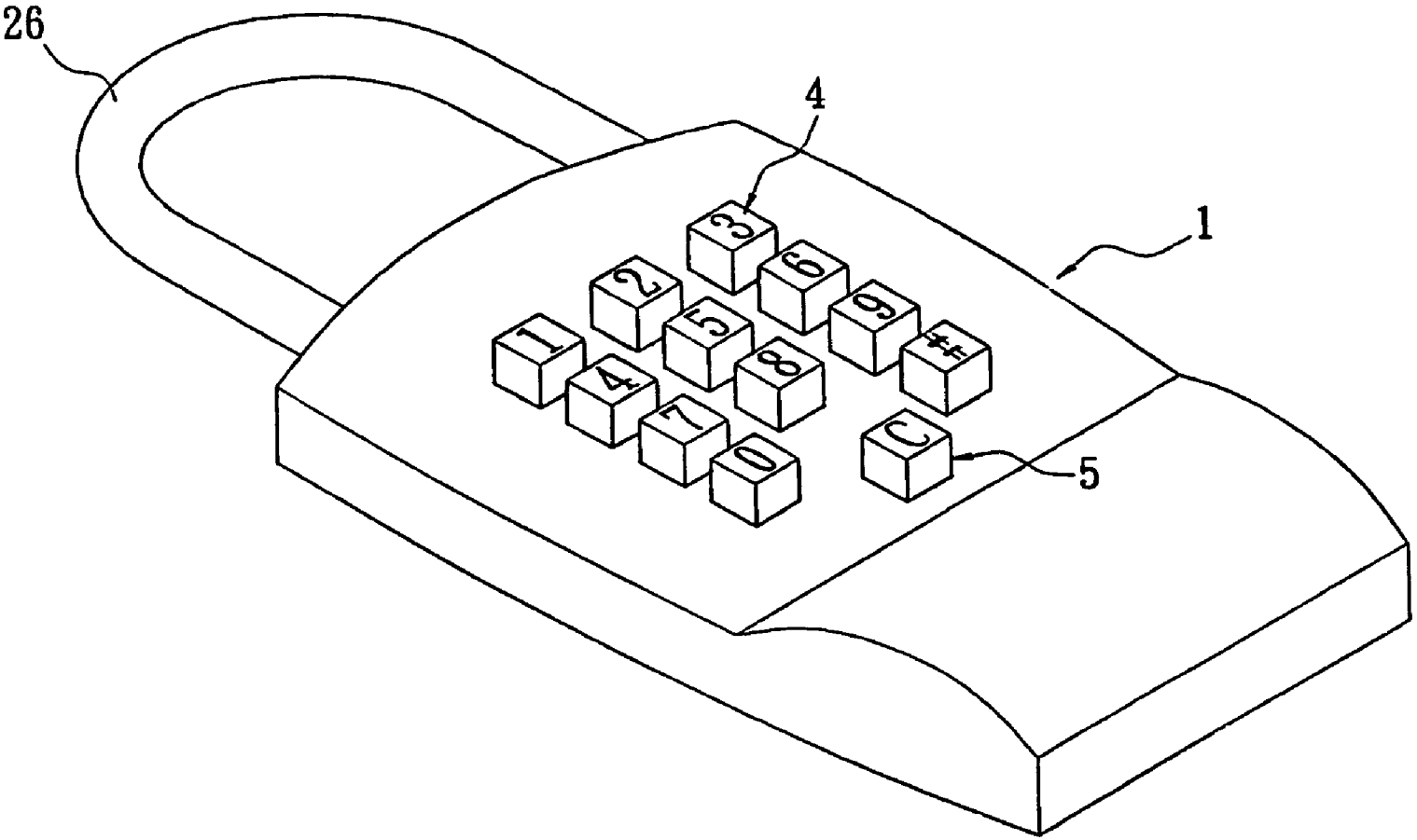
FIG. 9 is a perspective view of a key lock structure according to another embodiment of the present invention.

The key lock structure according to the present invention also matches manual lock. Illustrating in FIGS. 7 to 9, the sliding base 2 has a U-shaped necklace portion 26 disposed at a front thereof. An end of the necklace portion 26 is rotationally pivoted on the sliding base 2. An opposite end of the necklace portion 26 is received in the casing 1 while the key lock structure is locked. As mentioned above, the code-locked keystroke bodies 4 cannot be pressed while locked, thus, any codes cannot be input.

The stop portion 25 of the slide base 2 can barricade the extrusion portion 431 of the corresponding code-locked keystroke body 4. When the key lock structure according to the present invention is locked, no numerals can be input and no try-and-error manner can work.

Although the invention has been described in language specific to structural features and/or methodological steps, it is to be understood that the invention defined in the appended claims is not necessarily limited to the specific features or steps described. Rather, the specific features and steps are disclosed as preferred forms of implementing the claimed invention.

What is claimed is:

1. A key lock structure arranged in a mechanical key lock device, comprising:

a casing, a sliding base disposed in the casing; the sliding base having a plurality of elongation arms parallel to one another, a plurality of slots arranged with the elongation arms in a alternate manner, a plurality of stop portions disposed in the respective slots, and a tongue portion and a manual push portion together extended from front ends of the elongation arms; wherein the tongue portion is extruded from a front portion of the casing, the manual portion is extruded from a top face of the casing;

an orientation frame arranged on a bottom face of the sliding base and enclosing the slots; and a plurality of code-locked keystroke bodies penetrating the respective slots and the orientation frame; each of the code-locked keystroke bodies having a first slit formed on a lateral side thereof and a sliding member disposed in a inner portion thereof; wherein the sliding member has an extrusion portion exposed out the respective code-locked keystroke body via the respective first slit and further blocked by the respective stop portion.

2. The key lock structure as claimed in claim 1, wherein each of the code-locked keystroke bodies has a through hole formed on an opposite side thereof, the sliding member has a spheroid and two spheroidic slots; wherein the two spheroidic slots is relative to the through hole, the spheroid is alternatively arranged in two vacancies, which are formed between the through hole and the two spheroidic slots respectively.

3. The key lock structure as claimed in claim 1, wherein each of the code-locked keystroke bodies has a second slit formed on an opposite side thereof and a retaining member exposed slantingly out of the respective code-locked keystroke body via the second slit for resisting against a lower portion of the orientation frame or a lower portion of the sliding base.

4. The key lock structure as claimed in claim 3, wherein the retaining member is made of plastic materials integrally in one piece.

5. The key lock structure as claimed in claim 1, wherein the orientation frame has a first ramp formed thereon, and a plurality of arc slits formed on two lateral edges and corresponding to the slots respectively.

6. The key lock structure as claimed in claim 5, wherein the orientation frame has an arbitrary lock body extruding out of the top face of the casing, wherein the arbitrary lock body has a second ramp mating with and corresponding to the first ramp.

7. The key lock structure as claimed in claim 6, wherein the code-locked keystroke bodies and the arbitrary lock body have characters on respective surfaces thereof.

* * * * *